US012313372B2

(12) United States Patent
Wolfinbarger

(10) Patent No.: US 12,313,372 B2
(45) Date of Patent: May 27, 2025

(54) TOY COPTER RING LAUNCHER WITH AXIALLY STACKED RING MAGAZINE AND IMPROVED COPTER RING

(71) Applicant: Ryan Wolfinbarger, Avon, IN (US)

(72) Inventor: Ryan Wolfinbarger, Avon, IN (US)

( * ) Notice: Subject to any disclaimer, the term of this patent is extended or adjusted under 35 U.S.C. 154(b) by 109 days.

(21) Appl. No.: 18/175,968

(22) Filed: Feb. 28, 2023

(65) Prior Publication Data

US 2023/0296347 A1 Sep. 21, 2023

Related U.S. Application Data

(60) Provisional application No. 63/316,448, filed on Mar. 4, 2022.

(51) Int. Cl.

| | |
|---|---|
| ***F41B 7/08*** | (2006.01) |
| ***F41A 9/07*** | (2006.01) |
| ***F41B 7/00*** | (2006.01) |
| ***F41J 9/08*** | (2006.01) |
| *F41A 9/78* | (2006.01) |

(52) U.S. Cl.

CPC ..... *F41B 7/08* (2013.01); *F41B 7/006* (2013.01); *F41A 9/78* (2013.01); *F41B 7/003* (2013.01); *F41J 9/08* (2013.01)

(58) Field of Classification Search

CPC .. F41B 7/08; F41B 7/006; F41B 7/003; F41A 9/78; F41J 9/30; F41J 9/18; F41J 9/08; A63B 69/40

See application file for complete search history.

(56) References Cited

U.S. PATENT DOCUMENTS

| | | | | |
|---|---|---|---|---|
| 3,605,328 | A * | 9/1971 | Kilroy | A63H 27/14 124/16 |
| 6,076,511 | A | 6/2000 | Grimm et al. | |
| 6,079,398 | A * | 6/2000 | Grimm | A63H 27/14 124/16 |
| 9,004,052 | B1 * | 4/2015 | Poirier | F41B 7/006 124/47 |
| 2008/0022988 | A1 * | 1/2008 | Rosenblum | F41A 21/06 124/16 |
| 2010/0282227 | A1 * | 11/2010 | Vanek | F41B 7/08 124/31 |
| 2016/0238339 | A1 * | 8/2016 | Mitchell | F41B 7/08 |
| 2017/0284764 | A1 * | 10/2017 | Mellen | F41B 7/08 |
| 2021/0116222 | A1 * | 4/2021 | Lulay | F42B 10/06 |
| 2022/0178661 | A1 * | 6/2022 | Larsen | F41J 9/18 |

* cited by examiner

*Primary Examiner* — John E Simms, Jr.
(74) *Attorney, Agent, or Firm* — Volpe Koenig

(57) ABSTRACT

A toy launcher that can launch the flying rings over 100 feet with a more stable trajectory and more accurate trajectory based on the ring and blade configuration. The toy launcher includes a magazine assembly in which a plurality of the flying rings can be loaded in an axial direction, aligned with a launch direction. The rings are rotated up to speed and launched via movement of a sliding handle in a first direction, and the next ring in the magazine is advanced to the launch position by a return movement of the handle.

33 Claims, 16 Drawing Sheets

TOY COPTER RING LAUNCHER WITH AXIALLY STACKED RING MAGAZINE AND IMPROVED COPTER RING

CROSS-REFERENCE TO RELATED APPLICATIONS

This application claims the benefit of U.S. provisional patent application No. 63/316,448, filed Mar. 4, 2022, which is incorporated herein by reference as if fully set forth.

FIELD OF THE INVENTION

The present invention relates generally to toy projectiles and launchers for toy projectiles, and more particularly, the present invention relates to a ring launcher with an associated ring.

BACKGROUND

Toy projectile launchers are known. These include toy dart, ball, and ring launchers. Part of the enjoyment for users is being able to control and direct the flight of the projectiles, and shooting the projectiles longer distances with greater accuracy adds to the attraction of these toys.

Ballistic type toy projectiles, which includes rubber-tipped foam darts as well as plastic, foam and/or rubber tipped arrows or missiles or balls are well known. A drawback of these toys is the inherent parabolic flight path, which limits both distance and accuracy. In order to address this toy projectiles in the form of airfoil rings are provided in U.S. Pat. No. 6,076,511 that generate lift during flight overcome these limitations and have the ability to provide substantially level flight trajectory. The disclosed airfoil ring has the ability to generate lift during flight offering the potential for substantially level flight over increased distances. Further, the launchers disclosed therein impart spin on the ring airfoil as it is launched. The spinning action enhances lift generation and gyro-stabilizes the ring airfoil on its flight path. This was described as providing both increased flight distance and accuracy to target.

It is also known from U.S. Pat. No. 6,076,511 to provide ring airfoils from an elastomeric material that is rigid enough to permit the launcher to transfer launching energy to the ring airfoil, yet soft enough that the kinetic energy density for a given launch velocity, i.e., the kinetic energy of the ring airfoil at launch, is within industry guidelines. Softer materials expand upon impact increasing the surface area thereby reducing the energy per unit area.

However, an issue with this prior art is that for multi-ring storage on the toy launcher, each ring is loaded into an enlarged, revolver or drum-type rotary magazine that must be rotated in order to bring the next ring into a position to be spun up to speed and launched. This requires a complex assembly and results in an unwieldy size for the toy launcher. Further the airfoil ring has limited travel distance and stability since the thrust is provided by the launch mechanism What is needed is an improved toy launcher with a less complex mechanism, an improved size, and enhanced performance.

SUMMARY

In one aspect, the present disclosure is directed to a toy launcher for flying rings, with each ring having a ring hub with a center opening, an outer ring body, and blades extending from the ring hub to the outer ring body. The toy launcher includes a housing having a proximal end and a discharge end, a magazine assembly configured to receive a plurality of the rings axially aligned with one another for launching from the launcher, and a launching mechanism connected to the housing. The magazine assembly includes a center tube extending along an axis on which the rings are adapted to be slidably received, a pressure plate that is slidable on the center tube, a spring configured to act against a first one of the rings inserted in the magazine, preferably via a pressure plate, and a part of the housing, a discharge catch located at the discharge end of the housing and configured to hold the ring located closest to a discharge end in a launch position, with the discharge catch being movable between a holding position and a release position, and an advancing catch located at least about a ring width from the discharge catch toward the proximal end of the housing and configured to hold one or more of the rings on the center tube against a force of the spring that is applied by the pressure plate, with the advancing catch being movable between a holding position and a loading position. The launching mechanism includes a drive spindle extending through the center tube along the axis and having a drive hub that is configured to engage the ring hub of the ring held by the discharge catch, a drive assembly connected to the spindle that is activatable to rotate the spindle, and a discharge catch release that is activatable to move the discharge catch to the release position as the drive assembly is activated to rotate the spindle. This allows the flying ring to launch from the discharge end when the spindle has spun the flying ring to a high rotational speed and the drive assembly is deactivate. An advancing catch release is provided that is activatable to move the advancing catch to a loading position in which a next one of the rings in the magazine assembly is moved to the launch position after a previous one of the rings is launched and the discharge catch has returned to the holding position.

With this arrangement, the toy launcher can launch the flying rings over 100 feet with a more stable trajectory and more accurate trajectory based on the ring and blade configuration, exceeding the performance of any of the previously known devices.

In one arrangement the center tube includes at least one axially extending groove that is configured to receive at least one drive pin located on the ring hub. The drive hub also includes at least one slot that is configured to engage the at least one drive pin on one of the rings in the launch position.

In a preferred exemplary embodiment, the at least one axially extending groove comprises two axially extending grooves located on opposite sides of the center tube, and the at least one slot on the drive hub comprises two of the slots that are located on opposite sides of the drive hub.

In one embodiment, a spindle alignment cam is fixed to the drive spindle, and a spring biased positioning stop engages against the spindle alignment cam such that the drive spindle is stopped in a defined rotational position.

In a preferred arrangement, the spindle alignment cam includes two cam lobes, and the spring biased positioning stop is configured to rotate the drive spindle to a position between the two cam lobes to stop the drive spindle in a position where the slots on the drive hub are aligned with the axially extending grooves on the center tube. This allows for easier loading of the flying rings into the magazine assembly.

In one exemplary embodiment, the drive assembly includes a slidable handle connected to the housing, such that movement of the slidable handle from an initial position near the discharge end in a first direction toward the proximal end causes the drive spindle and the drive hub connected thereto to rotate. This can be accomplished by a gear rack connected to the slidable handle, and a gear train having at least a first gear that is engageable with the gear rack and a last gear rotationally fixed to the drive spindle, wherein movement of the slidable handle causes the first gear to rotate and transmit the rotational force via the gear train to the last gear in order to rotate drive spindle and the drive hub. Alternatively, the drive assembly can include a spring-loaded mechanism or an electric motor that is switched off and on by movement of the slidable handle or any other suitable trigger mechanism, or the drive assembly can include a cable drive using a cable attached to a sliding handle as well as pulleys to rotate the drive spindle. For the embodiment where the drive assembly includes the rack and the gear train, preferably the first gear is slidably mounted to the housing such that movement of the slidable handle and the attached gear rack in the first direction causes the first gear to engage with a next gear in the gear train, and movement of the slidable handle and the attached gear rack in a second direction, opposite to the first direction, slidably moves the first gear to a disengaged position from the next gear in the gear train. This allows the gear train to be disengaged during a return motion of the slidable handle.

In a preferred arrangement, the gear train has a drive ratio of at least 3:1, and more preferably in the range of 5:1 to 8:1 in order to accelerate the drive spindle and the engaged flying ring in the launch position to a high speed for long and stable flight.

In one exemplary embodiment, the discharge catch release and the advancing catch release are located on a catch actuator plate, the catch actuator plate is slidably mounted in the housing for movement in the axial direction, and the slidable handle is releasably engageable with the catch actuator plate for: (a) limited movement of the catch actuator plate in the first direction to a rear position as the slidable handle is moved from an initial position near the discharge end in the first direction such that the discharge catch release moves the discharge catch from the holding position to the release position, and (b) limited return movement of the catch actuator plate in the second direction to a front position as the slidable handle is moved in the second direction from a rearmost travel position back to the initial position such that the discharge catch release moves the discharge catch from the release position to the holding position and the advancing catch release moves the advancing catch from the holding position to the loading position and back to the holding position after a next one of the rings advances to the launch position.

This arrangement provides for automatic release of the flying ring in the launch position when it has rotated up to seed and the drive assembly is disengaged or stopped, and also automatically feeds the next flying ring from the magazine assembly into the launch position.

For enhanced functionality a spring-biased cam can be connected to the slidable handle that is engageable with and disengageable from the catch actuator plate in order to move the catch actuator plate in the first and second directions.

Further in order to enhance performance, for the arrangement where the spindle alignment cam is fixed to the drive spindle, and the spring biased positioning stop engages against the spindle alignment cam such that the drive spindle is stopped in a defined rotational position which allows for easier loading of the flying rings into the magazine assembly, an actuator arm can be provided that is engageable with the spring biased positioning stop to move the spring biased positioning stop to a disengaged position from the spindle alignment cam in order to reduce the friction or load that would be created by continuous contact. Preferably, the actuator arm is connected to the catch actuator plate, and moves the spring biased positioning stop to the disengaged position as the catch actuator plate moves to the rear position in conjunction with rotation of the drive spindle.

Preferably, the catch actuator plate includes at least one slot by which the catch actuator plate is slidably mounted in the housing, and the at least one slot defines an extent of the limited movement.

With this arrangement, the axis is substantially aligned with a direction of flight of the ring, allowing for a more compact arrangement of the magazine and housing resulting in a better overall look and operation of the toy launcher.

In another aspect, a toy is provided that includes the toy launcher as disclosed herein as well as plurality of the flying rings, with each of the flying rings having a ring hub with a center opening, an outer ring body, and blades extending from the ring hub to the outer ring body. In one preferred embodiment, the blades have an airfoil shape. Preferably, the blades have an attack angle of 20° to 60°.

In another embodiment, the flying rings are formed of a first polymer, which can be for example polypropylene, polyethylene, or any other suitable polymeric material. A second polymer having a softer durometer than the first polymer is then preferably molded or formed on, or otherwise attached to leading edge of the outer ring body. This provides for a softer impact of the flying ring on any object that it may contact, providing enhanced safety.

Preferably, at least one drive pin is located on the ring hub, the drive hub includes at least one slot that is configured to engage the at least one drive pin on one of the rings in the launch position, and the center tube includes at least one axially extending groove that receives the at least one drive pin. Preferably, the slot in the drive hub includes a ring-receiving recess on a drive side of the slot.

As explained above, in a preferred embodiment, the at least one axially extending groove comprises two axially extending grooves located on opposite sides of the center tube, the at least one slot on the drive hub comprises two of the slots that are located on opposite sides of the drive hub, and the at least one drive pin comprises two of the drive pins located on opposite sides of the opening in the ring hub.

It is noted that various ones of the above-noted features can be used alone or in combination with one another.

To this end, in a further embodiment, a toy launcher for flying rings is provided for launching rings as described above having a ring hub with a center opening, an outer ring body, and blades extending from the ring hub to the outer ring body. The toy launcher has a housing having a proximal end and a discharge end, and a magazine configured to receive a plurality of the rings axially aligned with one another for launching from the launcher. The magazine assembly includes a support that is configured to slidably receive the rings. This can be the support tube, a support rod, or just an outer housing. This can also be the tube support. A ring holder is located at a discharge end of the housing and configured to hold the ring located closest to a discharge end in a launch position. This can be formed by a frictional fit of the ring to the magazine, or can be provided as a discharge catch that is movable between a holding position and a release position. A launching mechanism is connected to the housing, and includes a drive assembly having a drive hub that is configured to engage the ring hub of the ring held at the discharge end and rotate the ring. This can be via a drive shaft or spindle.

In one preferred aspect, a spring acts against a first one of the rings that is inserted in the magazine. The spring can act directly or via a pressure plate. The spring is supported on or against a portion of the housing, which can be a spring support that is an integral part of the housing or attached to the housing.

In one preferred aspect, a discharge catch release is provided that is activatable to move the discharge catch to the release position as the drive assembly is activated to rotate the ring.

In another preferred aspect, an advancing catch is located at least about a ring width from the discharge catch toward the proximal end of the housing and configured to hold one or more of the rings in the magazine against a force of the spring, with the advancing catch being movable between a holding position and a loading position. Further, an advancing catch release is preferably also provided that is activatable to move the advancing catch to a loading position in which a next one of the rings in the magazine assembly is moved to the launch position after a previous one of the rings is launched and the discharge catch has returned to the holding position.

In one arrangement, the drive assembly drive assembly includes a slidable handle connected to the housing and configured to be moved linearly to rotate the drive hub.

In one preferred arrangement, a gear rack is connected to the slidable handle, and a gear train located between the gear rack and the drive hub that is configured to rotate the drive hub as the slidable handle is moved in at least one direction.

In a further aspect, a toy comprising the toy launcher described above is provided along with a plurality of the flying rings. The toy provides improved user experience by having the ability to hold a plurality of the rings in the magazine of the toy launcher, eliminating the need to manually re-load after each ring is discharged.

In a further embodiment, the toy launcher can be configured for launching a single ring using many of the advantageous features described herein. The toy launcher is configured for launching a flying rings as described herein, the ring having a ring hub with a center opening, an outer ring body, and blades extending from the ring hub to the outer ring body. The toy launcher includes a housing having a proximal end and a discharge end. A receiving area for a flying ring is provided at the discharge end of the housing. Here for a single ring, a magazine space is not required. A ring holder is located at a discharge end of the housing and configured to hold the ring in a launch position. This can be the discharge catch as described herein, or a friction fit between the ring hub and the drive hub. A launching mechanism is connected to the housing, with the launching mechanism including a drive assembly having the drive hub that is configured to engage the ring hub of the ring held at the discharge end and rotate the ring. The launching mechanism can include a slidable handle connected to the housing, such that movement of the slidable handle in a first direction causes the drive hub to rotate. In one arrangement, a gear rack is connected to the slidable handle, and a gear train having at least a first gear that is engageable with the gear rack and a last gear rotationally fixed to the drive hub is provided such that movement of the slidable handle from the initial position near the discharge end in a first direction toward the proximal end causes the first gear to rotate and transmit the rotational force via the gear train to the last gear in order to rotate the drive hub connected thereto. This action causes the ring to rotate to a launch speed and launch. A drive spindle can be provided between the last gear and the drive hub. Alternatively, the drive assembly can include a spring-loaded mechanism or an electric motor that is switched off and on by movement of the slidable handle or any other suitable trigger mechanism, or the drive assembly can include a cable drive using a cable attached to a sliding handle as well as pulleys to rotate the drive spindle.

In a further embodiment with the toy launcher configured for launching a single ring, the toy launcher includes a housing having a proximal end and a discharge end, and a receiving area for a flying ring at the discharge end. A launching mechanism is connected to the housing, with the launching mechanism including a drive assembly having a drive hub that is configured to engage the ring hub of the ring held at the discharge end and rotate the ring, and a release that is activatable as the drive assembly is activated to rotate the ring to that allows the ring to be launched. In one arrangement, a discharge catch is provided that is configured to hold the ring located in the receiving area in a launch position, and the discharge catch is movable between a holding position and a release position, and the release is a discharge catch release. Alternatively, the release can be formed by a friction fit with the ring and a portion of the housing or a part connected thereto that is overcome as the drive assembly is activated to rotate the ring.

Additional embodiments using some or all of the features disclosed herein are contemplated and provide advantages over the known devices.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION

Figure 1:
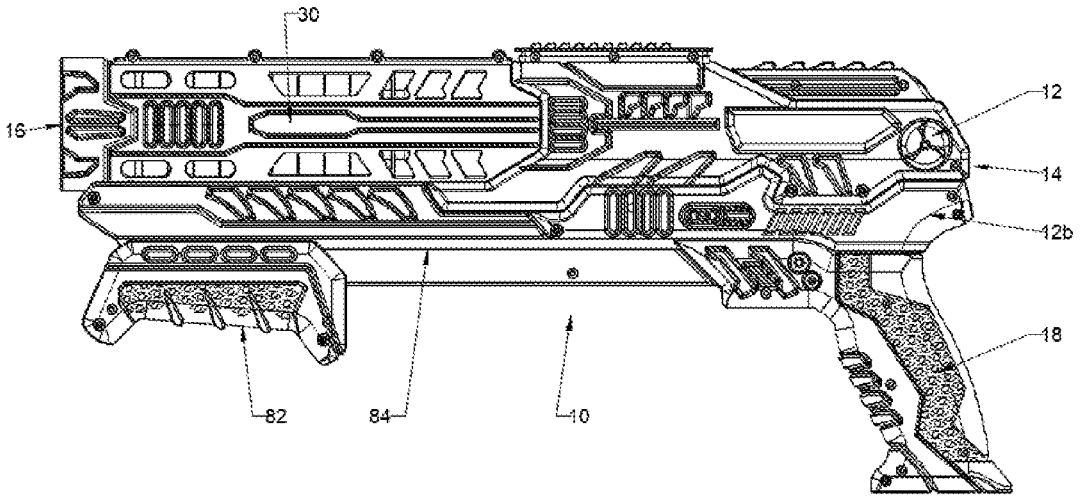
FIG. 1 is a left side elevational view of a toy launcher for flying rings in accordance with a preferred embodiment, with the right side elevational view being a mirror image thereof.

Certain terminology is used in the following description for convenience only and is not limiting. The words "inwardly" and "outwardly" refer to directions toward and away from the parts referenced in the drawings. A reference to a list of items that are cited as, for example, "at least one of a or b" (where a and b represent the items being listed) means any single one of the items a or b, or a combination of a and b thereof. This would also apply to lists of three or more items in like manner so that individual ones of the items or combinations thereof are included. The terms "about" and "approximately" encompass + or −10% of an indicated value unless otherwise noted. The term "generally" in connection with a radial direction encompasses +/−25 degrees. The terminology includes the words specifically noted above, derivatives thereof and words of similar import.

Figure 2:
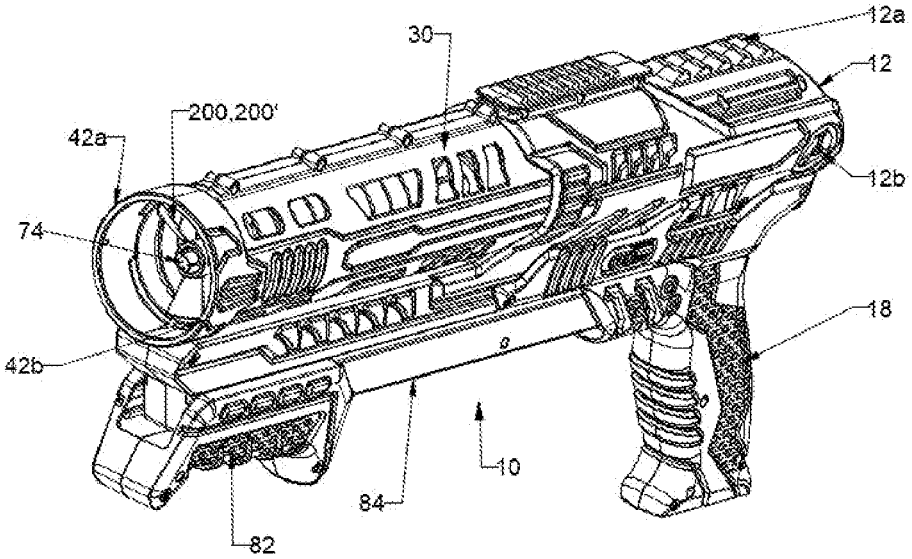
FIG. 2 is a perspective view of the toy launcher shown in FIG. 1.
Figure 19:
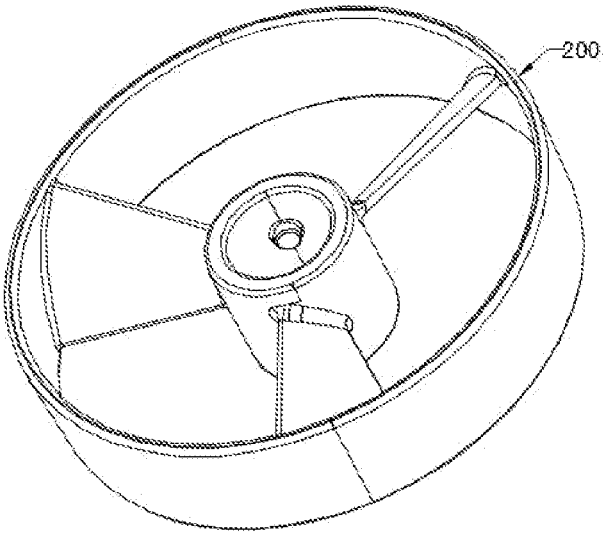
FIG. 19 is a perspective view of a first preferred embodiment of a flying ring for use with the toy launcher shown in FIGS. 1-18.
Figure 25:
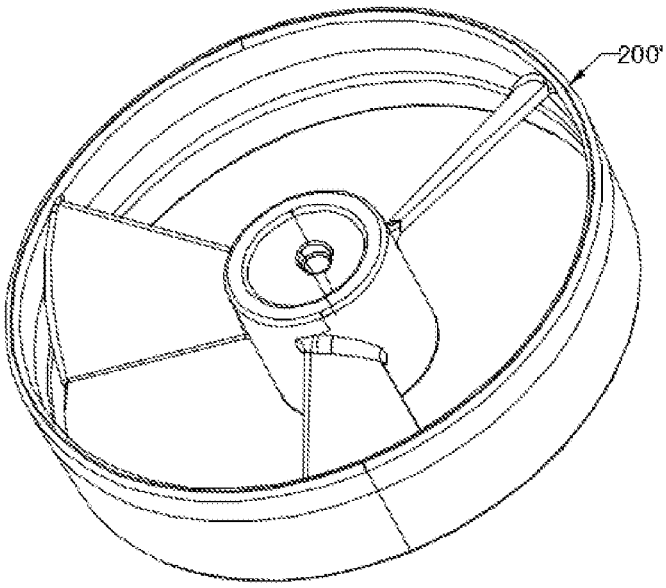
FIG. 25 is a perspective view of a second embodiment of a flying ring for the toy launcher of FIGS. 1-18.

Referring to FIGS. 1 and 2, a toy launcher 10 is shown for flying rings 200, 200' for example as shown in detail in FIGS. 19 and 25. As shown in FIGS. 19-24 and 25-30, each ring 200, 200' has a ring hub 202 with a center opening 204, an outer ring body 208, and blades 210*a*-210*c* extending from the ring hub 202 to the outer ring body 208. The outer ring body 208 may be tapered inwardly from the leading edge to the trailing edge. The flying rings 200, 200' preferably include at least one drive pin 206*a*, 206*b* located on the ring hub 202, preferably extending within the center opening 204. The blades 210*a*-210*c* preferably have an airfoil shape, as shown, for example in FIGS. 24 and 30. However, the specific airfoil shape is not required as long as the blades have an angle of attack. In the preferred configuration, the angle of attack is about 20° to 60°, and more preferably in the range of 40° to 50°. The flying rings 200, 200' are formed of a first polymer, for example, polyethylene or polypropylene. However, any suitable polymer can be used.

The configuration of the ring 200' shown in FIGS. 25-30 is the same as the configuration of the ring 200 shown in FIGS. 19-24, except that a second polymer having a softer durometer than the first polymer is provided on a leading edge 212 of the outer ring body 208. This can be a polyurethane or other elastomer. This is done in order to reduce the possibility of impact, harm or damage caused by the flying ring 200'.

Referring again to FIGS. 1 and 2, the toy launcher 10 includes a housing 12 having a proximal end 14 and a discharge end 16. The proximal end 14 can include a pistol grip 18; however, the specific configuration of the stock formed by the housing 12 can be varied. Preferably, the housing 12 is formed of housing halves 12*a*, 12*b* which enclose a magazine assembly 30 as well as a launching mechanism 70 as discussed in detail below. The magazine assembly 30 is configured to receive a plurality of the rings 200, 200' in an axially aligned manner with one another for a launching from the toy launcher 10.

Figure 20:
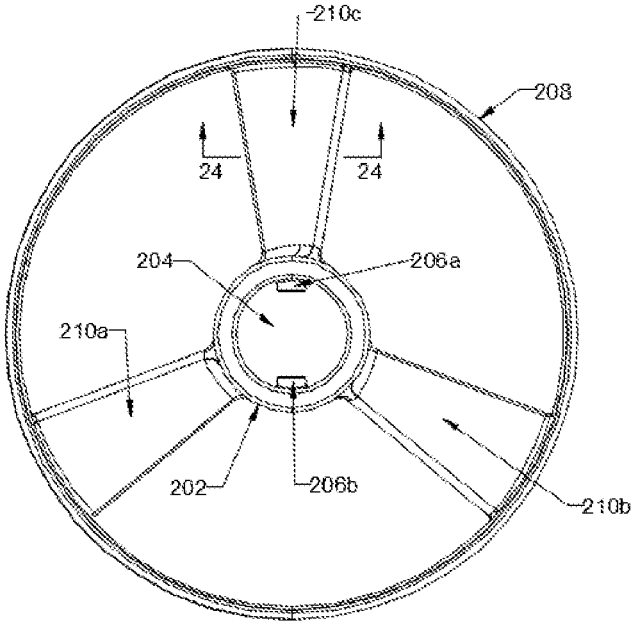
FIG. 20 is a front elevational view thereof.
Figure 21:
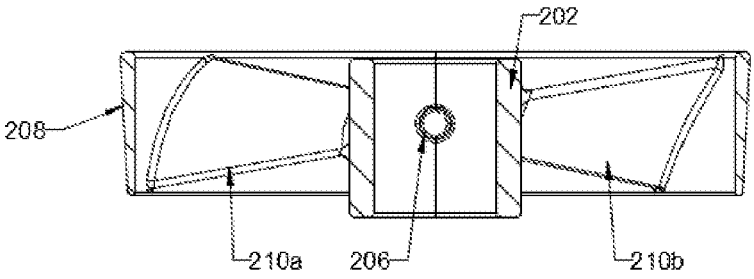
FIG. 21 is a cross-sectional view thereof.
Figure 22:
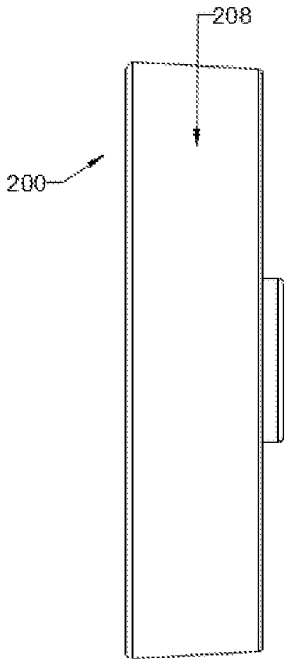
FIG. 22 is a side elevational view thereof.
Figure 23:
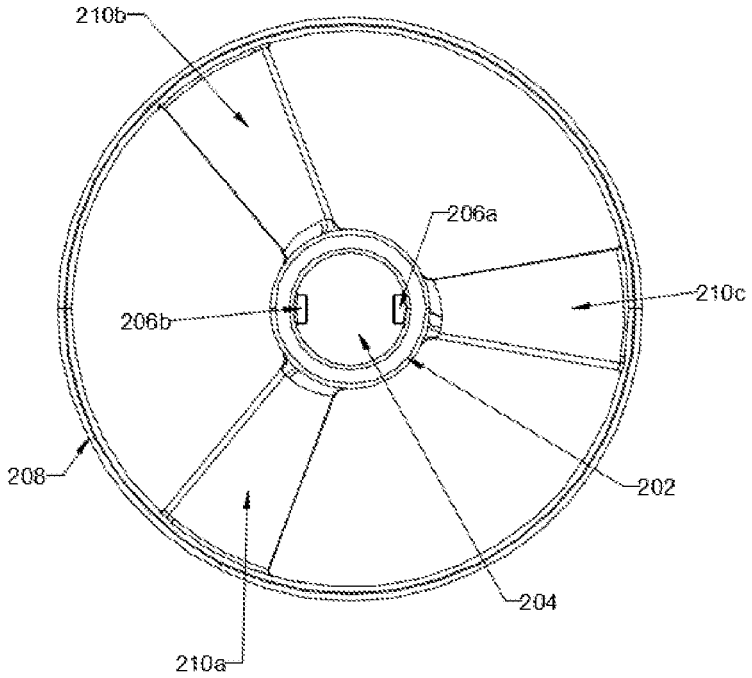
FIG. 23 is a rear elevational view thereof.
Figure 24:
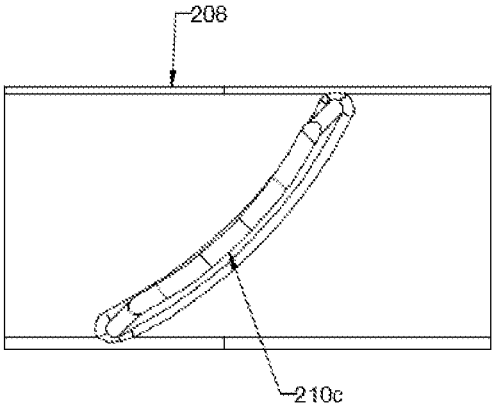
FIG. 24 is a cross-sectional view taken along line 24-24 in FIG. 20.
Figure 26:
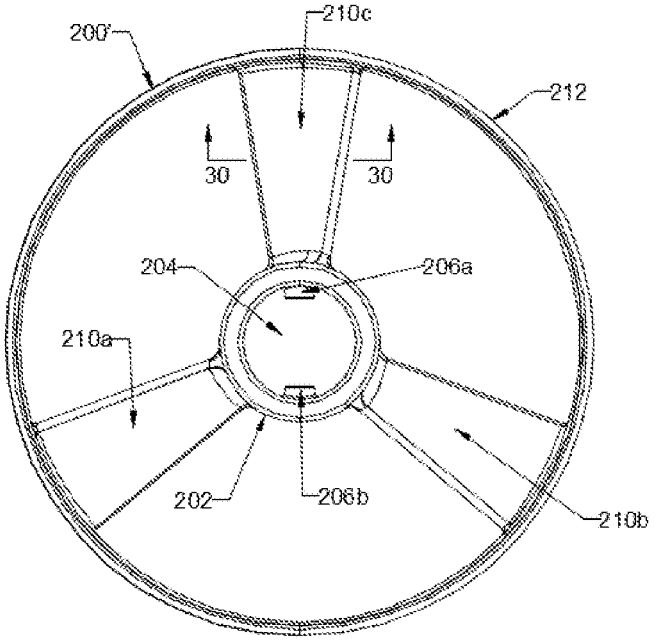
FIG. 26 is a front elevational view thereof.
Figure 27:
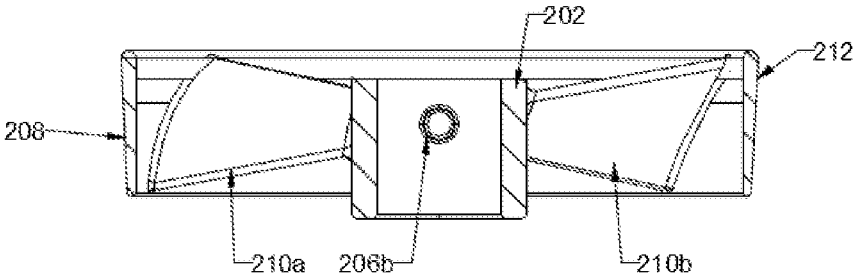
FIG. 27 is a cross-sectional view taken along line 27-27 in FIG. 26.
Figure 28:
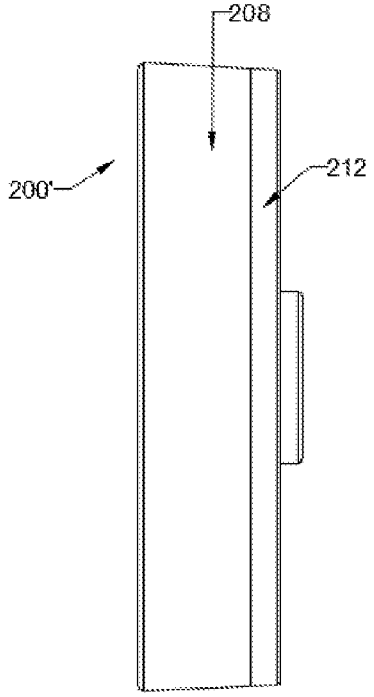
FIG. 28 is a side elevational view thereof.
Figure 29:
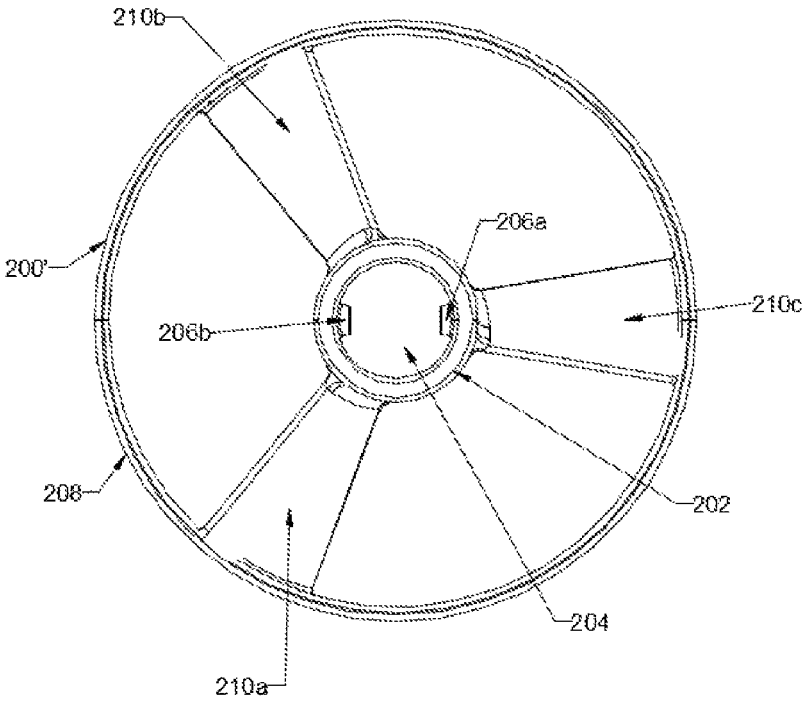
FIG. 29 is a rear elevational view thereof.
Figure 30:
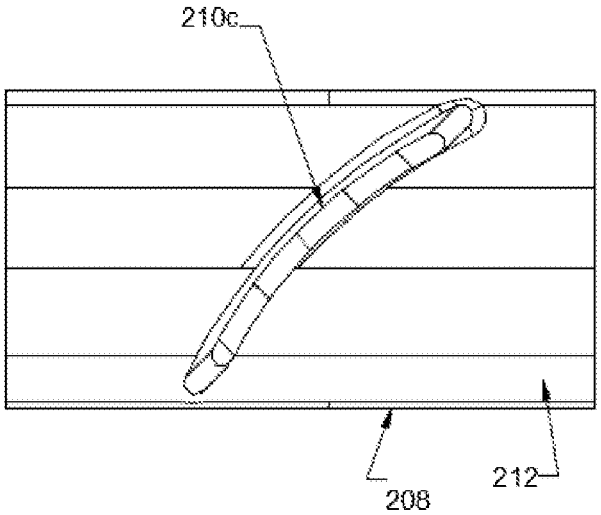
FIG. 30 is a cross-sectional view taken along line 30-30 in FIG. 26.

Referring to FIGS. 3-6, the magazine assembly 30 includes a center tube 32 that extends along a longitudinal axis X on which a plurality of the rings 200, 200' are adapted to be slidably received. The center tube 32 preferably includes at least one axially extending groove 32A, 34B that is configured to receive at least one drive pin 206*a*, 206*b* on the ring hub 202. More preferably, there are two of the grooves 34*a*, 34*b*, shown in detail in FIG. 6A, and two of the drive pins 206*a*, 206*b* are located on the ring hub 202, as shown in FIGS. 20 and 26.

A pressure plate 36 is slidably mounted on the center tube 32. A spring 38 extends between the pressure plate 36 and a tube support 40 that is fixed to the housing 12. The tube support 40 supports the center tube 32 in a cantilevered manner.

Figure 6:
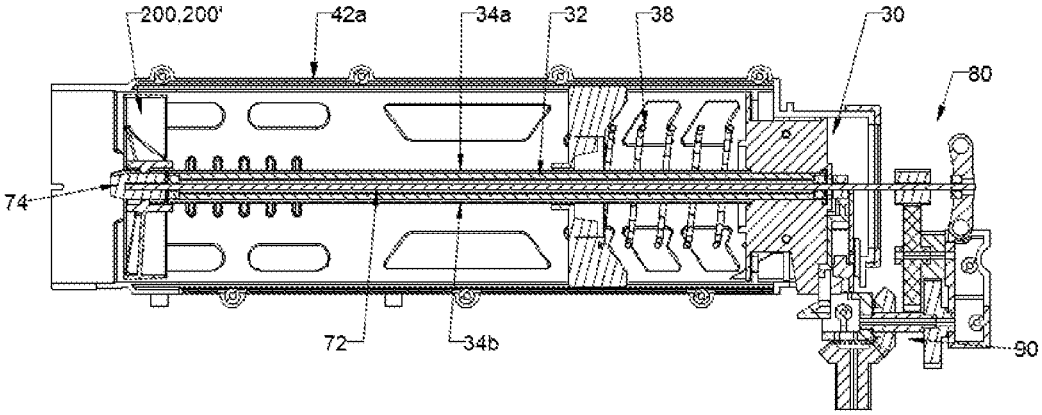
FIG. 6 is a cross-sectional view through the magazine assembly.

As shown in FIGS. 1, 2, and 6, a magazine housing 42, preferably formed in two halves 42*a*, 42*b* that can be connected together, surrounds the center tube 32 and defines a space for receiving the rings 200, 200' that are loaded into the magazine assembly 30. The magazine housing 42 is fixed to the housing 12.

Figure 3:
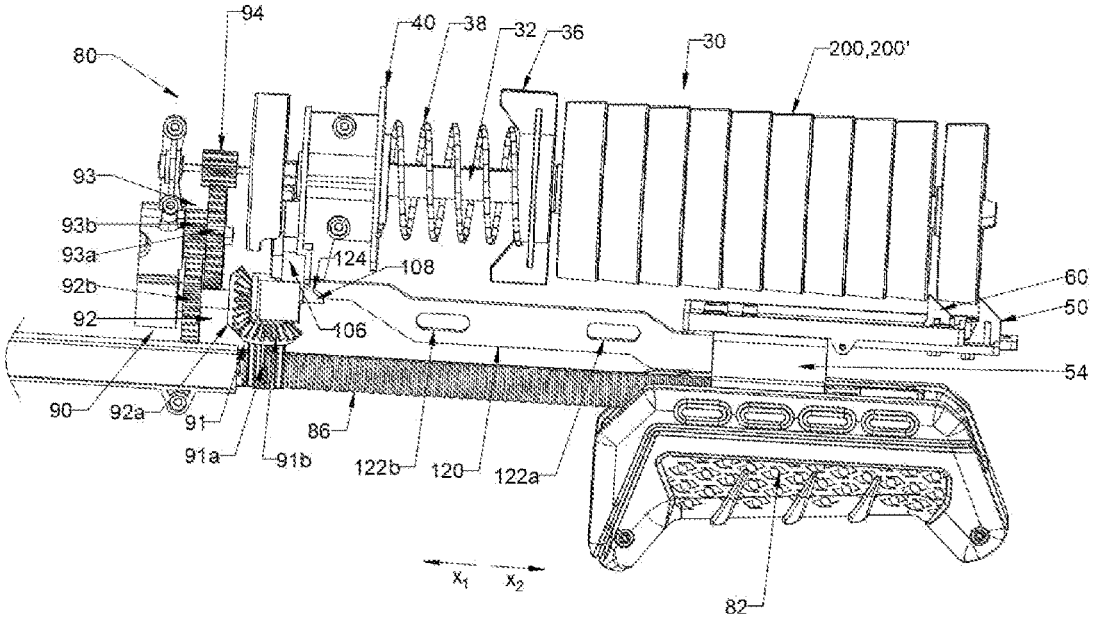
FIG. 3 is a partial right side view with the housing broken away showing an exemplary embodiment of a magazine assembly and launch mechanism of the toy launcher of FIG. 1, with the magazine loaded with flying rings.
Figure 4:
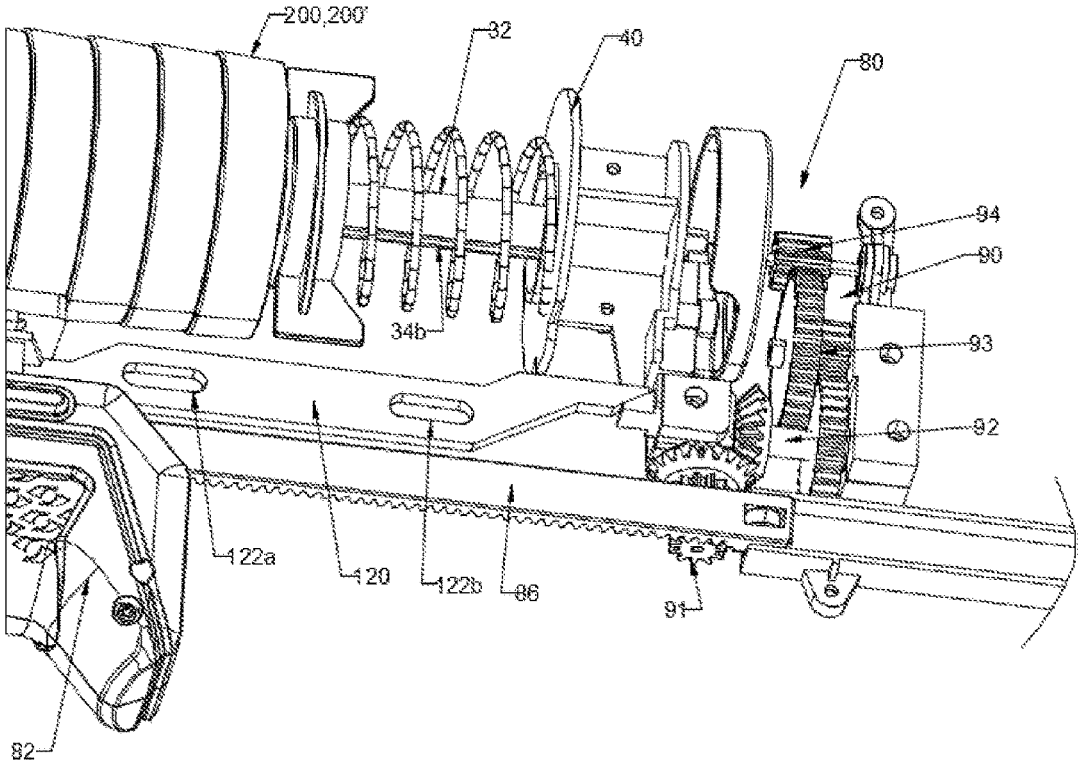
FIG. 4 is a partial perspective view showing the magazine assembly and launch mechanism from FIG. 3 from the opposite side.
Figure 5:
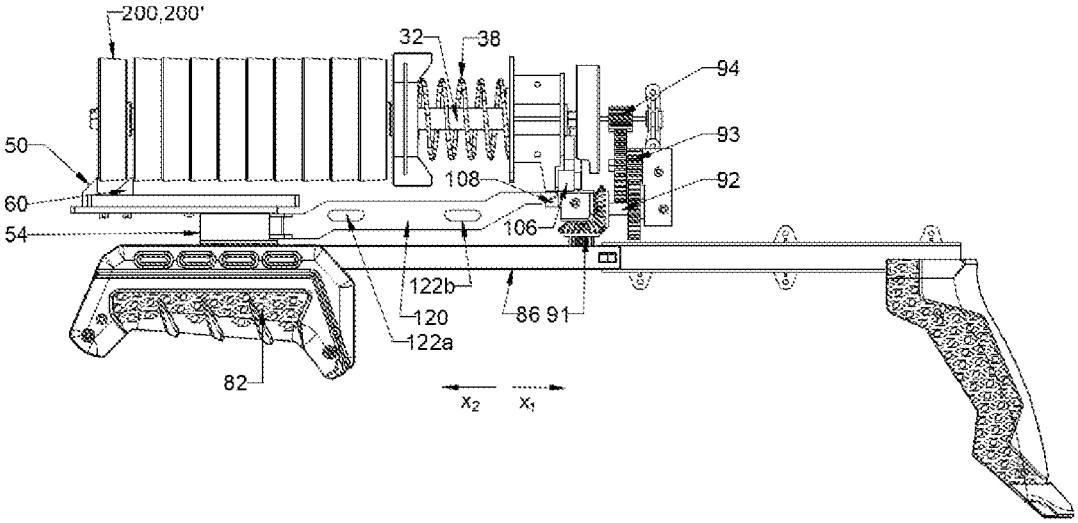
FIG. 5 is a left side elevational view showing the magazine assembly and launch mechanism of FIGS. 3 and 4.
Figure 6A:
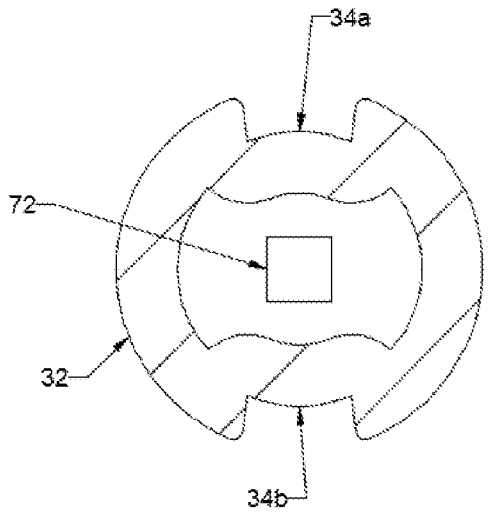
FIG. 6A is a cross-sectional view taken along line 6A-6A in FIG. 6.
Figure 8:
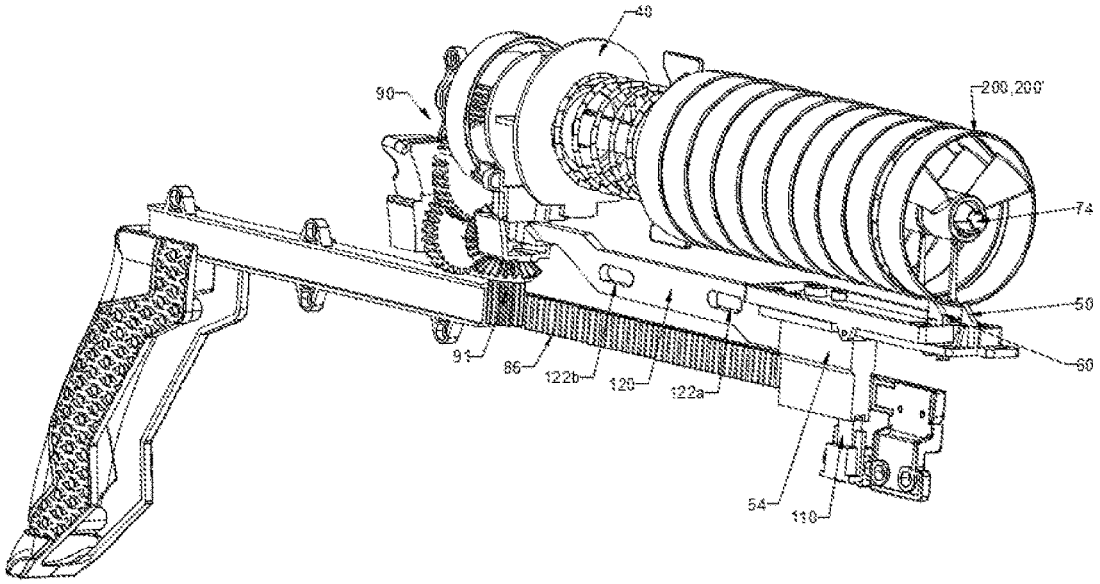
FIG. 8 is a front, right perspective view showing a front area of the magazine assembly and launch mechanism with the magazine shown fully loaded.
Figure 9:
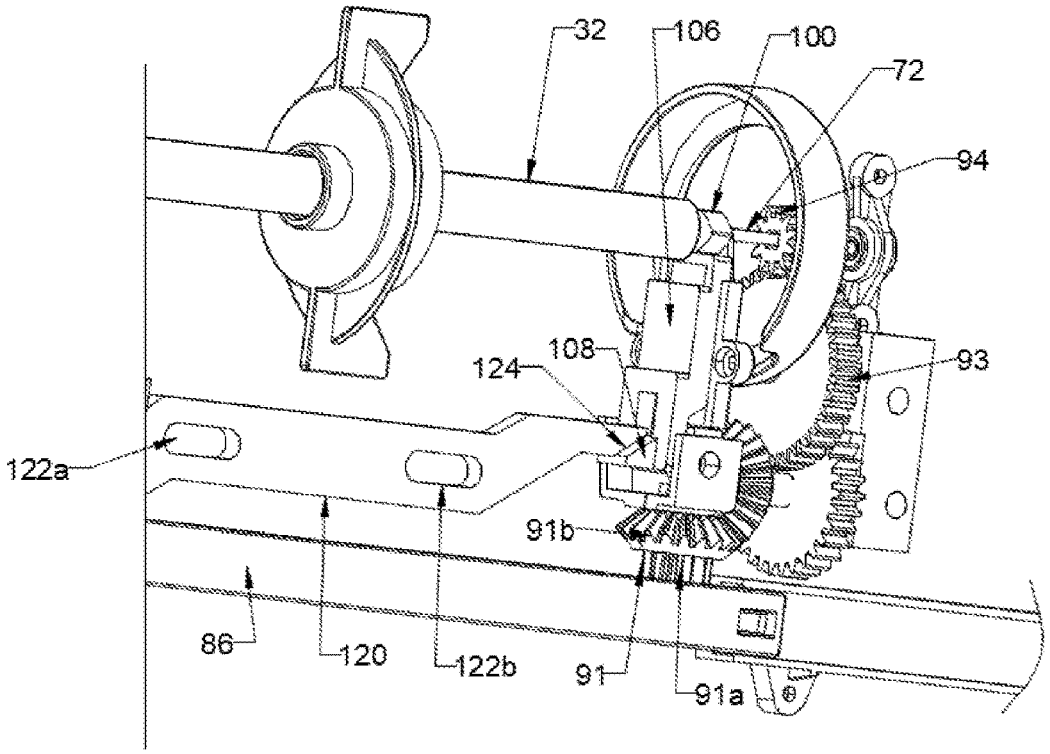
FIG. 9 is a perspective view highlighting the spring biased positioning stop that acts on the spindle alignment cam.
Figure 10:
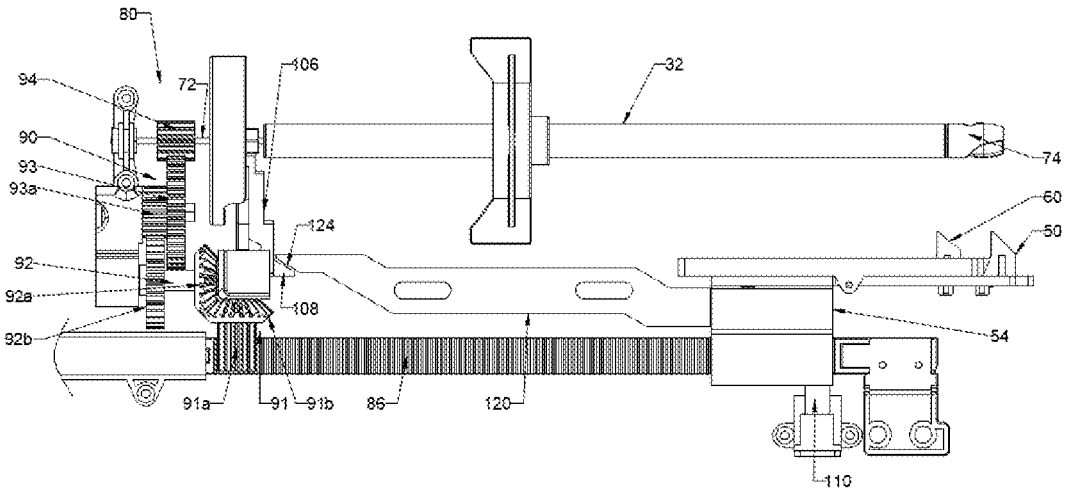
FIG. 10 is a right side elevational view of the magazine assembly and launch mechanism shown with the magazine empty.
Figure 11:
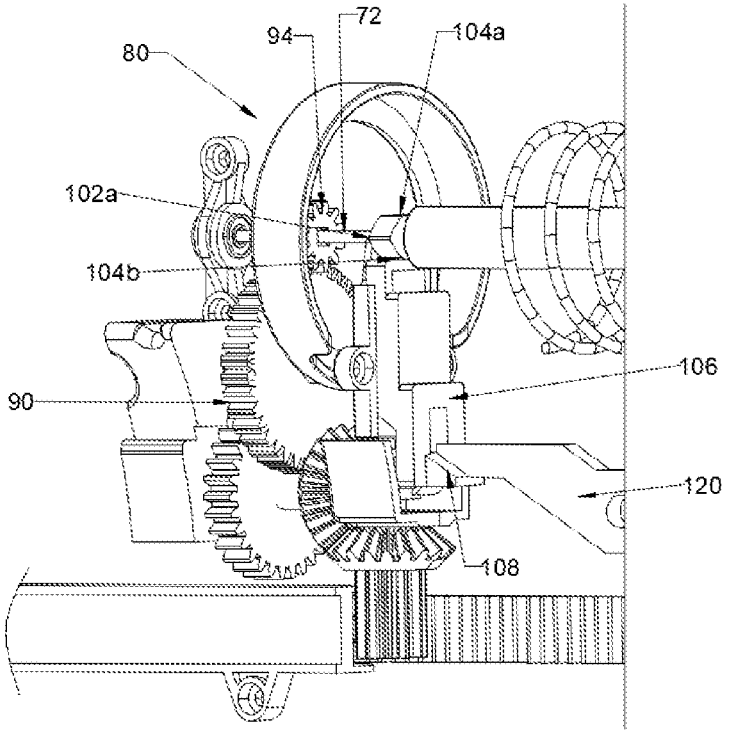
FIG. 11 is a perspective view showing the spring biased positioning stop acting on the spindle alignment cam, shown with the magazine empty.
Figure 12:
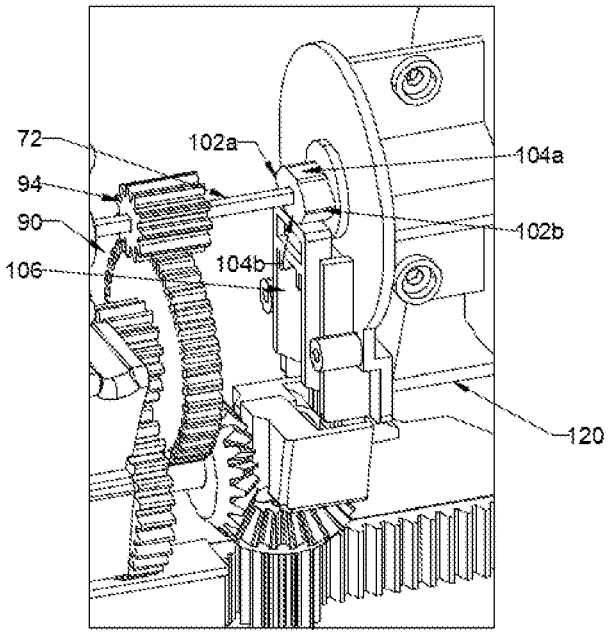
FIG. 12 is a further perspective view, taken from the left and rear, showing the spring biased positioning stop acting on the spindle alignment cam.

Referring to FIGS. 3 and 5 as well as FIGS. 8, 10, 13, and 15-18, a discharge catch 50 is located at the discharge end 16 of the housing 12 and is configured to hold the ring 200, 200' located closest to the discharge end 16 in a launch position L (indicated in FIGS. 3, 5, and 8). The discharge catch 50 is moveable between a holding position and a release position. Further, an advancing catch 60 is located at least about a ring width W form the discharge catch 50 toward the proximal end of the housing 12 and is configured to hold one or more of the rings 200, 200' on the center tube 32 against a force of the spring 38 that is applied by the pressure plate 36. The advancing catch 60 is movable between a holding position and a loading position. Respective springs 51, 61 resiliently bias the discharge catch 50 and the advancing catch 60 to the respective holding positions.

Referring now to FIGS. 3-18, the launching mechanism 70 will be described in detail. The launching mechanism 70 is connected to the housing 12 and includes a drive spindle 72 that extends through the center tube 32 along the axis X and includes a drive hub 74 at or near the discharge end 16, shown in detail in FIG. 18, that is configured to engage the ring hub 202 of the ring 200, 200' in the launch position L that is held by the discharge catch 50. Preferably, the drive hub 74 includes at least one slot 76*a*, 76*b* that is configured to engage the at least one drive pin 206*a*, 206*b* on one of the rings 200, 200' in the launch position L. Preferably, there are two of the slots 76*a*, 76*b* and there are two of the drive pins 206*a*, 206*b*. Further, preferably the at least one axially extending groove 34*a*, 34*b* in the center tube 32 comprises two of the axially extending grooves 34*a*, 34*b* that are located on opposite sides of the center tube 32. The slots 76*a*, 76*b* on the drive hub 74 are located on opposite sides of the drive hub 74 and are configured to be matching with and alignable with the axially extending grooves 34*a*, 34*b* in the center tube 32 to allow a ring 200, 200' to be slid over the drive hub 74 and on to the center tube 32 as the magazine assembly 30 is being loaded.

As shown in detail in FIGS. 3-7 and 10, a drive assembly 80 is connected to the spindle 72 and is activatable to rotate the spindle 72. The drive assembly 80 can be a motor activated by a switch/trigger or can be any type of manually activatable system that will rotate the drive spindle 72. In a preferred embodiment, the drive assembly 80 includes a slidable handle 82 that is movable along a handle guide 84 that is formed in or on, or is attached to the housing 12. A gear rack 86 is connected to the slidable handle 82, and a gear train 90 having at least a first gear 91 that is engageable with the gear rack 86 and at least a last gear 94 rotationally fixed to the drive spindle 72 is provided such that movement of the slidable handle 82 from an initial position near the discharge end 16 in a first direction X1 toward the proximal end 14 causes the first gear 91 to rotate and transmit the rotational force via the gear train 90 to the last gear 94 in order to rotate the drive spindle 72 and the drive hub 74 connected thereto.

In a preferred embodiment, the first gear is a bevel gear and includes two sets of teeth 91*a*, 91*b*, with the first set of teeth 91*a* adapted to be engaged by the gear rack 86 and the second set of teeth 91*b* being configured to be engageable with a second gear 92. The second gear 92 is a speed increasing gear and includes a first set of teeth 92*a* that are adapted to engage the second set of teeth 91*b* of the first gear 91, as well as a second set of teeth 92*b*, preferably having a 2:1 ratio to the first set of teeth 92*a* of the second gear 92. A third gear 93 is provided that is also a speed increasing gear and includes a first set of teeth 93*a* that are engaged to the second set of teeth 92*b* of the second gear 92, as well as a second set of teeth 93*b* that engage with the last gear 94 that is attached to the drive spindle 72. This gear train 90 preferably provides a speed increase from the first gear 90 to the last gear 94 of at least about 3:1 and more preferably in the range of 5:1 to 6:1. However, other gear ratios can be provided. Additionally, the number of gears in the gear train 90 could also be varied. The second and third gears 92, 93 are supported on a fixed axis of rotation, preferably u a gear shaft or other support. The fourth or last gear 94 is fixed to the drive spindle 72, which is preferably supported by a bearing surface in an area of the gear train 90, and may also be supported by a further bearing in the center tube 32 at or near the discharge end. The bearing surfaces may be formed from the plastic material of the housing or other components.

Figure 7:
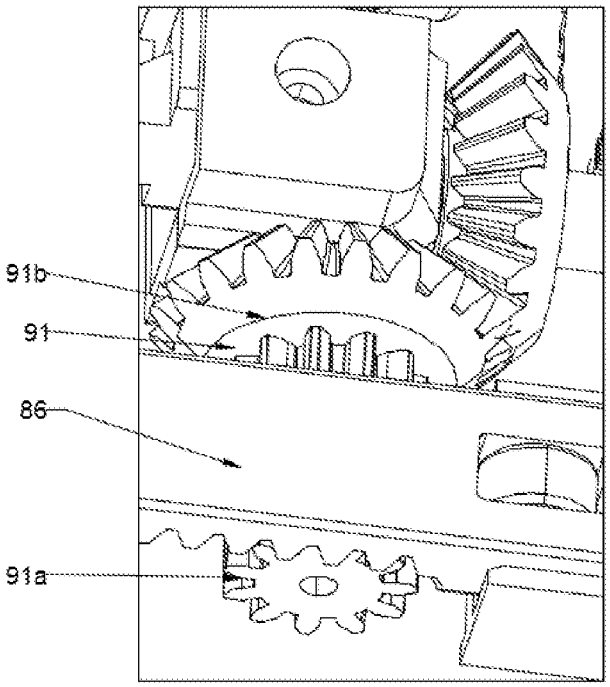
FIG. 7 is a detailed perspective view showing the first gear of the gear grain of the internal mechanism.
Figure 14:
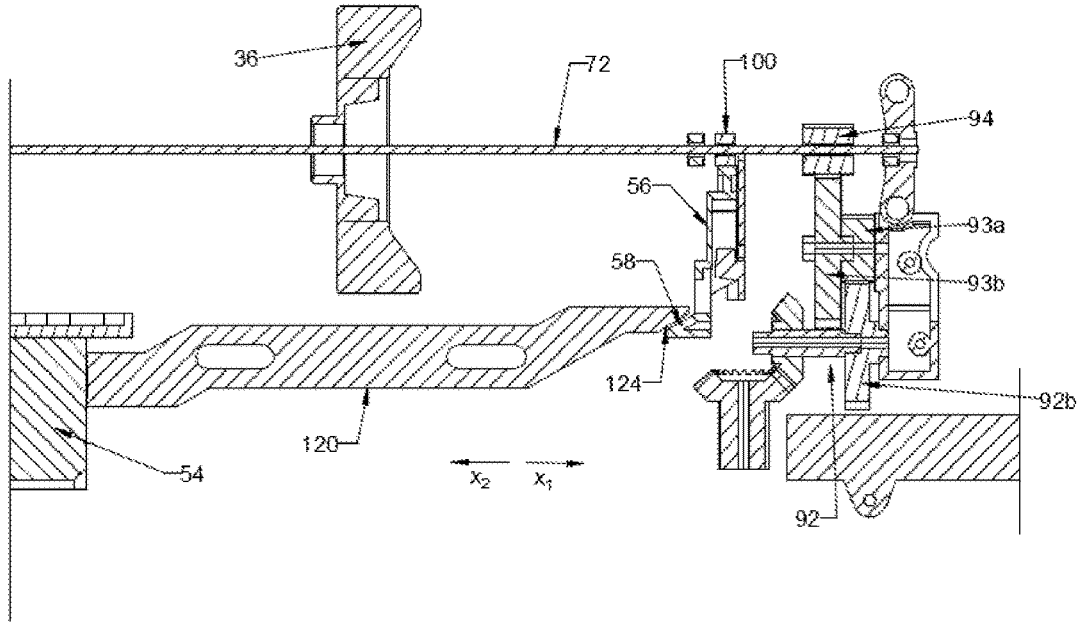
FIG. 14 is a cross-sectional view through the magazine assembly and launch mechanism showing a preferred embodiment of the gear train that drives the drive spindle.
Figure 15:
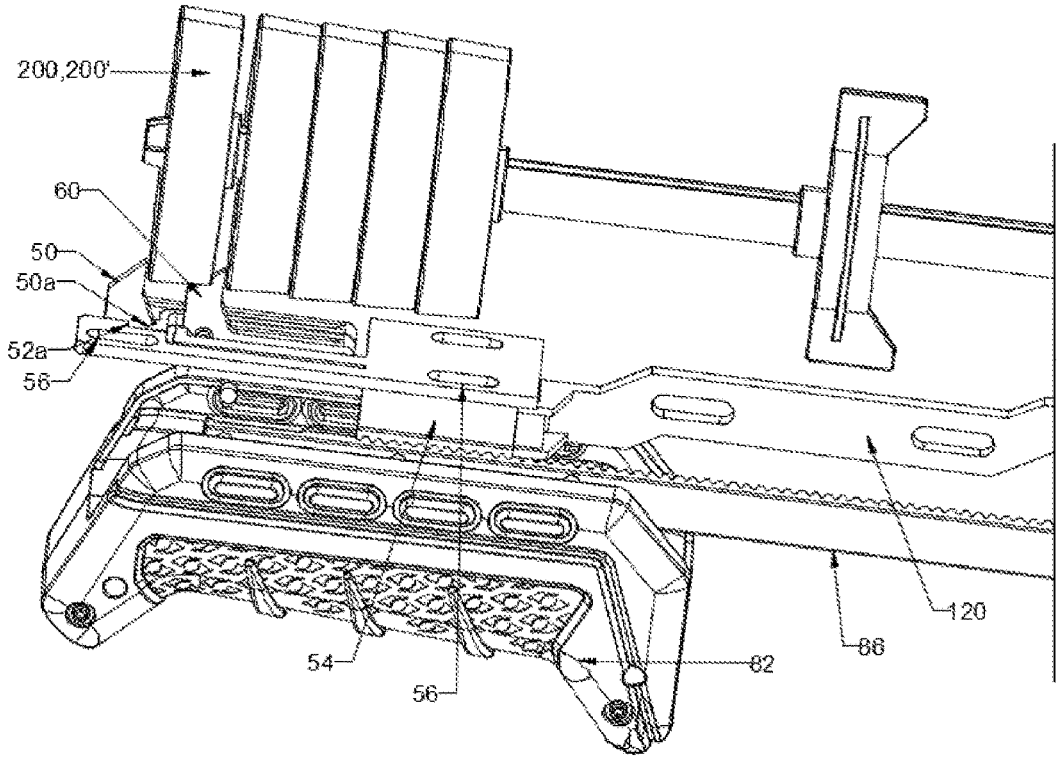
FIG. 15 is a perspective view, partially in cross-section, showing the catch actuator plate with the discharge catch release and the advancing catch release.
Figure 16:
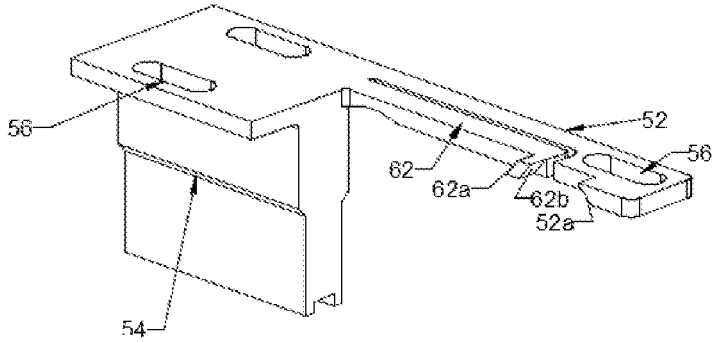
FIG. 16 is a detailed perspective view of the catch actuator plate.
Figure 17:
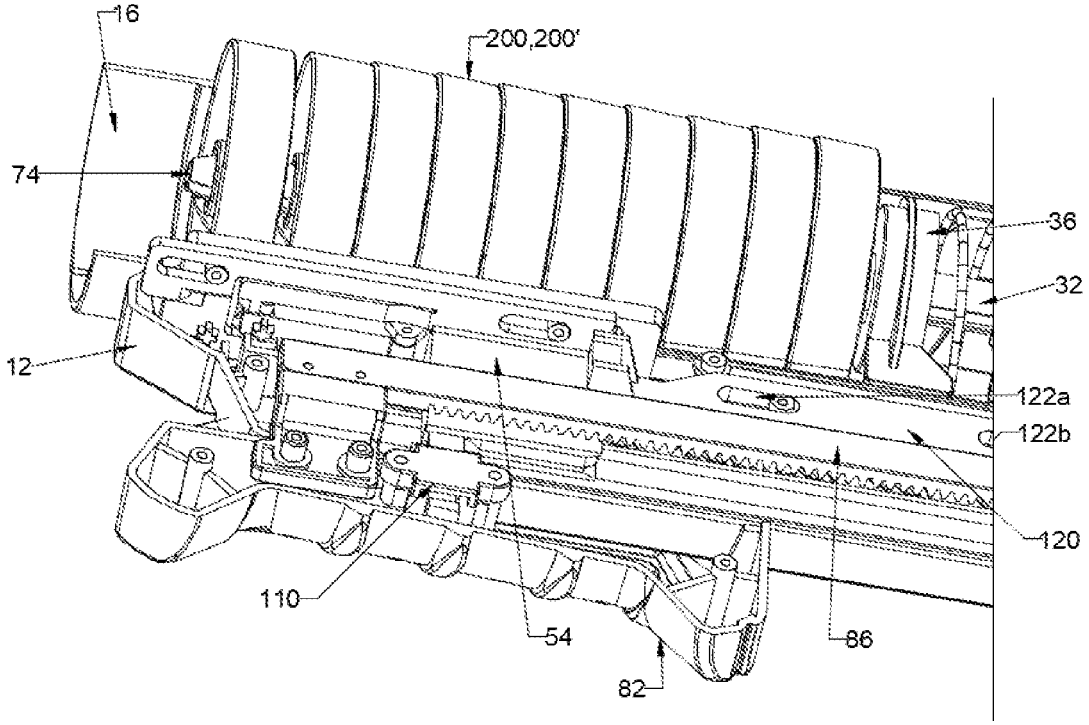
FIG. 17 is a perspective view showing the front of the magazine assembly and launch mechanism with the catch actuator plate in a forward-most position, with the magazine shown fully loaded.

Further, as shown in detail in FIGS. 7 and 14, the first gear 91 is preferably slideably mounted to the housing 12 via slotted mounting holes 20, the bottom one of which is seen in FIG. 7, such that movement of the slidable handle 82 and the attached gear rack 86 in the first direction X1 causes the first gear 91 to engage with the second gear 92 in the gear train 90, and movement of the slidable handle 82 and the attached gear rack 86 in a second direction X2, opposite the first direction X1, slideably moves the first gear 91 to a disengaged position from the second gear 92 in the gear train 90. This ensures that the return movement of the slidable handle 82 with the gear rack 86 does not result in an opposite drive direction being imparted to the gear train 90 and instead, the first gear 91 "kicks-out" of contact with the second gear 92.

Referring to FIGS. 3, 5, 8, 10, and 13-17, a discharge catch release 52 that is activatable to move the discharge catch 50 to the release position as the drive assembly 80 is activated to rotate the spindle 72 is provided. Additionally, an advancing catch release 62 that is activatable to move the advancing catch 60 to a loading position in which a next one of the rings 200, 200' in the magazine assembly 30 is moved to the launch position L after a previous one of the rings 200, 200' is launched and the discharge catch 50 has returned to the holding position is also shown. In a preferred embodiment, the discharge catch release 52 and the advancing catch release 62 are located on a catch actuator plate 54, shown in detail in FIGS. 13 and 15-17. Preferably, the discharge catch release 52 and the advancing catch release 62 are formed as separately flexible resilient arms, although only the advancing catch release 62 is required to flex up and down as part of its functioning. The catch actuator plate 54 is slidably mounted in the housing 12 for movement in the axial direction X. The slidable handle 82 is releasably engageable with the catch actuator plate 54 for (a) limited movement of the catch actuator plate 54 in the first direction X1 to a rear position as the slidable handle 82 is moved from the initial position near the discharge end 16 in the first direction X1 such that the discharge catch release 52 moves the discharge catch 50 from the holding position to the release position, and (b) limited return movement of the catch actuator plate 54 in the second direction X2 to a front position as the slidable handle 82 is moved in the second direction X2 from a rear most traveled position back to the initial position such that the discharge catch release 52 moves the discharge catch 50 from the release position to the holding position and the advancing catch release 62 moves the advancing catch 60 from the holding position to the loading position and back to the holding position after a next one of the rings 200, 200' advances to the launch position L. The catch actuator plate 54 is moved for its limited movement by the slidable handle 82 via a spring-biased cam 110 that is connected to the slidable handle 82 and that is engageable with and disengageble from the catch actuator plate 54 in order to move the catch actuator plate 54 in the first and second directions X1, X2. The spring-biased cam 110 includes a holder 112 that is connected to the handle 82 as well as a movable cam pin 114 that is biased outwardly via a spring (not shown).

Figure 13:
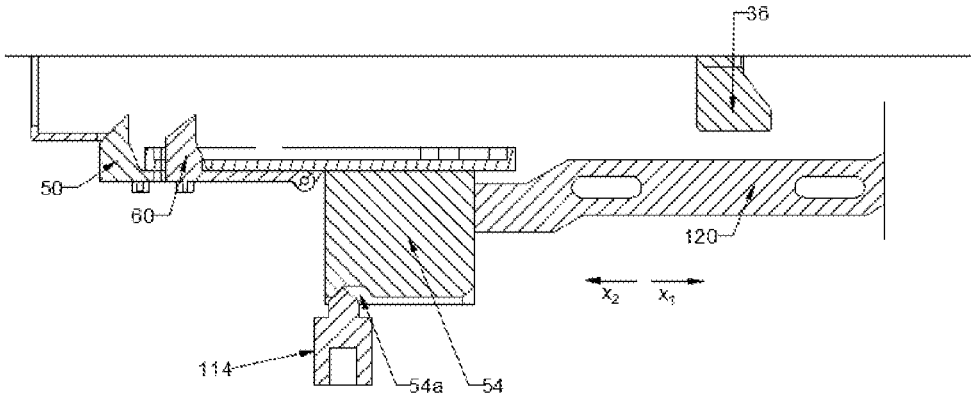
FIG. 13 is a cross-sectional view through the magazine assembly and launch mechanism showing the discharge catch and the advancing catch as well as the discharge catch release and the advancing catch release located on a catch actuator plate.
Figure 18:
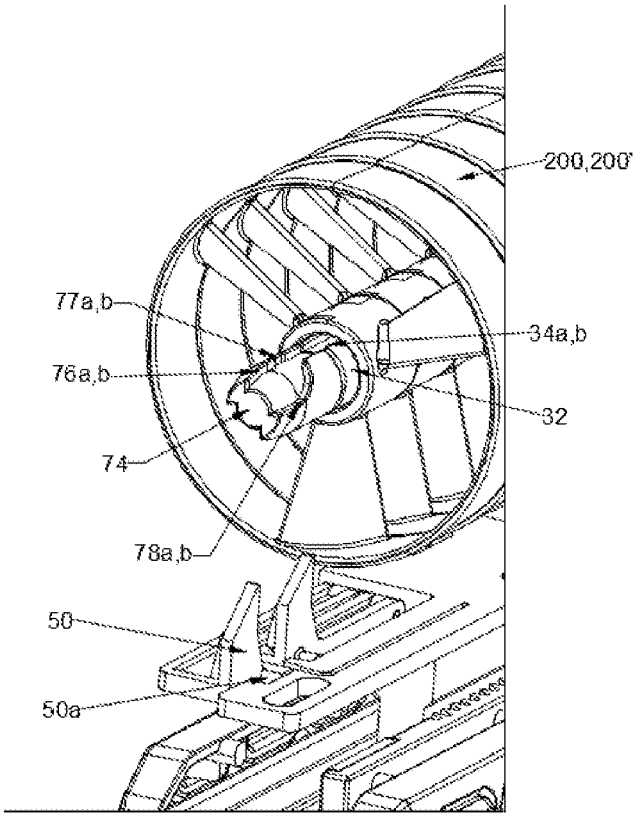
FIG. 18 is a detailed perspective view showing a front of the drive spindle with the drive hub.

Referring to FIG. 13, in which the catch actuator plate 54 and the handle 82 (shown partially obscured) are in the initial position, the spring biased cam 110 is engaged in a first slot 54*a* in the catch actuator plate 54. Both the discharge catch 50 as well as the advancing catch 60 are shown in the respective holding positions, with the springs 51, 61 biasing the discharge catch 50 and the advancing catch 60 to the holding positions. As the handle 82 is moved rearward, the spring-biased cam 110 connected to the handle moves in the first direction X1 while engaged in a first slot 54*a* in the catch actuator plate 54. This causes a first ramp surface 52*a* (see FIGS. 15 and 16) of the discharge catch release 52 on the catch actuator plate 54 to engage with a cam 50*a* on the discharge catch 50 (see FIG. 15) which presses the first catch 50 into the release position. The travel of the catch actuator plate 54 is limited via the slotted mounting holes 56 (shown in FIGS. 15 and 16) and movement in the X1 direction results in the cam 50*a* on the first catch 50 remaining held down by the discharge catch release 52 so that the discharge catch 50 is held in the release position. During this movement of the catch actuator plate 54, a first cam surface 62*a* on the advancing catch release 62 causes the advancing catch release 62 to be resiliently biased downwardly beneath a cam surface 60*a* on the advancing catch 60. This movement results in a force that acts in the same direction as the spring 61, maintaining the advancing catch 60 in the holding position. With the discharge catch 50 in the release position, the continued movement of the handle 82 with the gear rack 86 is used to accelerate the gear train 90 rotating the drive spindle 72 and the drive hub 74 at the discharge end 16. The ring 200, 200' in the launch position L has the drive pins 206*a*, 206*b* engaged in the slot 76*a*, 76*b* in the drive hub 74 and is accelerated. As shown in FIG. 18, the slots 76*a*, 76*b* may include recesses 77*a*, 77*b* that are specifically adapted to accommodate the drive pins 206*a*, 206*b* on the rings 200, 200'. As the handle 82 is moved backward, the spring-biased cam 110 moves out of the first slot 54*a* down beneath the bottom of the catch actuator plate 54 once the travel limit is reached, as defined by the slotted mounting holes 56, and continues its rearward movement to a rearward most position as defined by the housing 12. Once the catch actuator plate 54 along with the handle 82 reach the rearmost position, the movement of the drive spindle 72 stops and the rotating inertia of the ring 200, 200' in the launch position L as well as the launch force (lift, in this case directed along the X axis) generated by the blades 210*a*-210*c* causes the ring 200, 200' with its drive pins 206*a*, 206*b* to move, in a preferred embodiment in the clockwise direction, where the guide pins 206*a*, 206*b* are guided by the curved release profile 78*a*, 78*b* formed on an opposite side of the slot 76*a*, 76*b* from the recesses 77*a*, 77*b* such that the ring 200, 200' accelerates away from the toy launcher 10 based on the spinning movement imparted via the drive spindle 72. Return movement of the handle 82 to the point where the spring-biased cam 110 contacts a back edge of the catch actuator plate 54 and the continued movement of the handle 82 in the second direction X2 moving the catch actuator plate 54 in the second direction for limited movement back to its initial position. This results in the a second cam 62*b* on the advancing catch release 62 contacting and pressing down the cam 60*a* on the advancing catch 60 such that the advancing catch 60 is pressed down against the spring 61 allowing the spring 38 and the pressure plate 36 to press the remaining rings 200, 200' on the center tube 32 forward such that a next ring 200, 200' moves forward until it contacts the discharge catch 50 which is returned to the holding position at the same time by the movement of the discharge catch release 52 as the catch actuator plate 54 continues to move in the second direction X2. As soon as the second cam 62*b* on the advancing catch release 62 passes beneath the cam 60*a* on the advancing catch 60, the advancing catch 60 is returned via the spring 61 to the holding position.

Referring to FIGS. 9 and 11-14, the toy launcher 10 preferably includes a spindle alignment cam 100 that is fixed to the drive spindle 72 in order to align the components for ease of loading rings 200, 200' into the magazine assembly 30. A spring biased positioning stop 106 is mounted in the housing 12 and engages against the spindle alignment cam 100 such that the drive spindle 72 is stopped in a defined rotational position. The spindle alignment cam 100 includes two cam lobes 102*a*, 102*b*, as well as flats 104*a*, 104*b* located between the cam lobes 102*a*, 102*b*. The spring biased positioning stop 106 is configured to rotate the drive spindle 72 to a position between the two cam lobes 102*a*, 102*b* to stop the drive spindle 72 in a position where the slots 76*a*, 76*b* on the drive hub 72 are aligned with the axially extending grooves 34*a*, 34*b* on the center tube 32. Guides are formed in the housing that limit the movement of the spring biased positioning stop to a direction normal to the axis X.

In order to prevent frictional losses to the force transmitted via the drive assembly 80 to the drive spindle 72, preferably the spring biased positioning stop 106 is moved out of contact with the spindle alignment cam 100 as the drive assembly 80 is activated. In the preferred embodiment, an actuator arm 120 that is slideably moveable in the housing 12 via movement of the catch actuator plate 54 engages with the spring biased positioning stop 106 and moves the spring biased positioning stop 106 to a disengaged position as the catch actuator plate 54 moves in the first direction X1 to the rear position as the handle 82 is initially moved from its front-most position near the discharge end 16 in the first direction X1. The actuator arm 120 also has limited travel which is provided via slotted mounting holes 122*a*, 122*b*. The actuator arm 120 can move with the catch actuator plate 54 in both directions by a direct connection or can be spring biased in the second direction X2 toward the discharge end and be moved in the first direction X1 by contact with a surface of the catch actuator plate 54. Preferably, the actuator arm 120 includes a ramp surface 124 that engages a corresponding ramp surface 108 on the spring biased positioning stop 106.

In use, a user can load flying rings 200, 200' into the magazine assembly 30 by sliding them with the drive pin(s) 206*a*, 206*b* aligned with the slot(s) 76*a*, 76*b* in the drive hub 74 and on to the center tube 32 with the drive pin(s) 206*a*, 206*b* being received in the axially extending groove(s) 34*a*, 34*b*. The insertion movement presses the discharge catch 50 as well as the advancing catch 60 downwardly against the forces springs 51, 61, respectively, in order to allow loading. A plurality of the rings 200, 200' can be inserted with the force of insertion pressing back the pressure plate 36 against the force of the spring 38. In a preferred embodiment, 10 of the rings 200, 200' can be located into the magazine assembly 30.

For launching, a user moves the handle 82 in the first direction X1 from its forward position, resulting in the discharge catch 50 being moved from the holding position to the release position via the discharge catch release 52, which is preferably located on the catch actuator plate 54. As the user continues to move the handle 82 in the first direction X1 to its rear-most position, the gear rack 86 presses the first gear 91 of the gear train 90 into contact with the second (or next) gear 92, creating the rotational movement of the gear train 90 which is transmitted to the last gear 94 that is fixed onto the drive spindle 72. The drive spindle 72 rotates the drive hub 74 affixed at or near the discharge end 16 along with the flying ring 200, 200' that is in the launch position L on the drive hub 74. This rotational movement is transmitted via the slot(s) 76*a*, 76*b*, and preferably the recesses 77*a*, 77*b* in the slot(s) 76*a*, 76*b*, to the drive pin(s) 206*a*, 206*b* on the ring 200, 200' in the launch position L which is rotated to a high speed. When the handle 82 reaches the rear most position, the drive spindle 72 stops and the rotational inertia of the ring 200, 200' in the launch position causes the drive pin(s) 206*a*, 206*b* to move out from the recesses 77*a*, 77*b* and down the curved release profiles 78*a*, 78*b* on the opposite side of the slot(s) 76*a*, 76*b* from the recesses with the blades 210*a*-201*c* causing the ring 200, 200' to accelerate from the discharge end 16 of the toy launcher. Using this arrangement, the rings 200, 200' can travel 100+ feet with high flight stability.

Return movement of the handle 82 causes the discharge catch release 52 to move from the release position such that the discharge catch 50 is moved back to the holding position via the spring 51. At the same time, the advancing catch release 62 is activated to move the advancing catch 60 to a loading position in which a next one of the rings 200, 200' in the magazine assembly 30 is moved to the launch position L via pressure from the spring 38 acting against the pressure plate 36. Once the next ring 200, 200' is in the launch position L, the advancing catch release 62 allows the advancing catch 60 to return to the holding position from the loading position.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A toy launcher for flying rings, each ring having a ring hub with a center opening, an outer ring body, and blades extending from the ring hub to the outer ring body, and the toy launcher comprising:

a housing having a proximal end and a discharge end;

a magazine assembly configured to receive a plurality of the rings axially aligned with one another for launching from the launcher, the magazine assembly comprising, a center tube extending along an axis that is adapted to slidably receive the rings, a spring that is configured to act on a first one of the rings inserted in the magazine and is supported against a part of the housing, a discharge catch located at the discharge end of the housing and configured to hold the ring located closest to a discharge end in a launch position, the discharge catch being movable between a holding position and a release position, and an advancing catch located at least about a ring width from the discharge catch toward the proximal end of the housing and configured to hold one or more of the rings on the center tube against a force of the spring, the advancing catch being movable between a holding position and a loading position;

a launching mechanism connected to the housing, the launching mechanism comprising, a drive spindle extending through the center tube along the axis and having a drive hub that is configured to engage the ring hub of the ring held by the discharge catch, a drive assembly connected to the spindle that is activatable to rotate the spindle, and a discharge catch release that is activatable to move the discharge catch to the release position as the drive assembly is activated to rotate the spindle; and an advancing catch release that is activatable to move the advancing catch to a loading position in which a next one of the rings in the magazine assembly is moved to the launch position after a previous one of the rings is launched and the discharge catch has returned to the holding position.

2. A toy launcher for flying rings, each ring comprising a ring hub with a drive pin extending into a center opening, an outer ring body, and blades extending from the ring hub to the outer ring body, and the toy launcher comprising:

a housing having a proximal end and a discharge end;

a magazine assembly configured to receive a plurality of the rings axially aligned with one another for launching from the launcher, the magazine assembly comprising, a center tube extending along an axis that is adapted to slidably receive the rings, a spring that is configured to act on a first one of the rings inserted in the magazine and is supported against a part of the housing, a discharge catch located at the discharge end of the housing and configured to hold the ring located closest to a discharge end in a launch position, the discharge catch being movable between a holding position and a release position, and an advancing catch located at least about a ring width from the discharge catch toward the proximal end of the housing and configured to hold one or more of the rings on the center tube against a force of the spring, the advancing catch being movable between a holding position and a loading position;

a launching mechanism connected to the housing, the launching mechanism comprising, a drive spindle extending through the center tube along the axis and having a drive hub that is configured to engage the ring hub of the ring held by the discharge catch, a drive assembly connected to the spindle that is activatable to rotate the spindle, and a discharge catch release that is activatable to move the discharge catch to the release position as the drive assembly is activated to rotate the spindle;

an advancing catch release that is activatable to move the advancing catch to a loading position in which a next one of the rings in the magazine assembly is moved to the launch position after a previous one of the rings is launched and the discharge catch has returned to the holding position; and the center tube includes at least one axially extending groove that is adapted to receive the drive pin located on the ring hub.

3. The toy launcher of claim 2, wherein the drive hub includes at least one slot that is adapted to engage the at least one drive pin on one of the rings in the launch position.

4. The toy launcher of claim 3, wherein the at least one axially extending groove comprises two axially extending grooves located on opposite sides of the center tube, and the at least one slot on the drive hub comprises two of the slots that are located on opposite sides of the drive hub.

5. The toy launcher of claim 4, further comprising a spindle alignment cam fixed to the drive spindle, and a spring biased positioning stop that engages against the spindle alignment cam such that the drive spindle is stopped in a defined rotational position.

6. The toy launcher of claim 5, wherein the spindle alignment cam includes two cam lobes, and the spring biased positioning stop is configured to rotate the drive spindle to a position between the two cam lobes to stop the drive spindle in a position where the slots on the drive hub are aligned with the axially extending grooves.

7. The toy launcher of claim 1, wherein the drive assembly includes a slidable handle connected to the housing, a gear rack connected to the slidable handle, and a gear train having at least a first gear that is engageable with the gear rack and a last gear rotationally fixed to the drive spindle such that movement of the slidable handle from an initial position near the discharge end in a first direction toward the proximal end causes the first gear to rotate and transmit the rotational force via the gear train to the last gear in order to rotate the drive spindle and the drive hub connected thereto.

8. The toy launcher of claim 7, wherein the first gear is slidably mounted to the housing such that movement of the slidable handle and the attached gear rack in the first direction causes the first gear to engage with a next gear in the gear train, and movement of the slidable handle and the attached gear rack in a second direction, opposite to the first direction, slidably moves the first gear to a disengaged position from the next gear in the gear train.

9. The toy launcher of claim 7, wherein the gear train provides a gear ratio of at least 3:1 to rotate the drive spindle.

10. The toy launcher of claim 7, wherein the discharge catch release and the advancing catch release are located on a catch actuator plate, the catch actuator plate is slidably mounted in the housing for movement in the axial direction, the slidable handle is releasably engageable with the catch actuator plate for (a) limited movement of the catch actuator plate in the first direction to a rear position as the slidable handle is moved from an initial position near the discharge end in the first direction such that the discharge catch release moves the discharge catch from the holding position to the release position, and (b) limited return movement of the catch actuator plate in the second direction to a front position as the slidable handle is moved in the second direction from a rearmost travel position back to the initial position such that the discharge catch release moves the discharge catch from the release position to the holding position and the advancing catch release moves the advancing catch from the holding position to the loading position and back to the holding position after a next one of the rings advances to the launch position.

11. The toy launcher of claim 10, further comprising a spring-biased cam connected to the slidable handle that is engageable with and disengageable from the catch actuator plate in order to move the catch actuator plate in the first and second directions.

12. The toy launcher of claim 10, further comprising a spindle alignment cam fixed to the drive spindle, a spring biased positioning stop that engages against the spindle alignment cam such that the drive spindle is stopped in a defined rotational position, and an actuator arm that is engageable with the spring biased positioning stop to move the spring biased positioning stop to a disengaged position from the spindle alignment cam, and the actuator arm is connected to the catch actuator plate, and moves the spring biased positioning stop to the disengaged position as the catch actuator plate moves to the rear position.

13. The toy launcher of claim 10, wherein the catch actuator plate includes at least one slot by which the catch actuator plate is slidably mounted in the housing, and the at least one slot defines an extent of the limited movement.

14. The toy launcher of claim 1, further comprising a pressure plate that is slidable on the center tube, and the spring acts against the pressure plate which is configured to contact the first one of the rings inserted in the magazine.

15. The toy launcher of claim 1, wherein the axis is substantially aligned with a direction of flight of the ring.

16. A toy comprising the toy launcher according to claim 1 and a plurality of the flying rings, each said flying ring having a ring hub with a center opening, an outer ring body, and blades extending from the ring hub to the outer ring body.

17. The toy of claim 16, wherein the blades have an airfoil shape.

18. The toy of claim 16, wherein the blades have an attack angle of 20° to 60°.

19. The toy of claim 16, wherein the flying rings are formed of a first polymer.

20. The toy of claim 19, further comprising a second polymer having a softer durometer than the first polymer on a leading edge of the outer ring body.

21. The toy of claim 16, further comprising at least one drive pin located on the ring hub, the drive hub includes at least one slot that is configured to engage the at least one drive pin on one of the rings in the launch position, and the center tube includes at least one axially extending groove that receives the at least one drive pin.

22. The toy of claim 21, wherein the at least one axially extending groove comprises two axially extending grooves located on opposite sides of the center tube, the at least one slot on the drive hub comprises two of the slots that are located on opposite sides of the drive hub, and the at least one drive pin comprises two of the drive pins located on opposite sides of the opening in the ring hub.

23. A toy launcher for flying rings, each ring having a ring hub with a center opening, an outer ring body, and blades extending from the ring hub to the outer ring body, and the toy launcher comprising:

a housing having a proximal end and a discharge end;

a magazine configured to receive a plurality of the rings axially aligned with one another for launching from the launcher, the magazine assembly comprising, a support that is configured to slidably receive the rings, a ring holder located at a discharge end of the housing and configured to hold the ring located closest to a discharge end in a launch position, and a launching mechanism connected to the housing, the launching mechanism comprising a drive assembly having a drive spindle that extends axially through the support that is configured to slidably receive the rings, and a drive hub connected to the drive spindle that is configured to engage the ring hub of the ring held at the discharge end and rotate the ring.

24. The toy launcher of claim 23, further comprising a spring that acts against a first one of the rings that is inserted in the magazine, the spring being supported directly or indirectly by the housing.

25. The toy launcher of claim 23, further comprising the ring holder comprising a discharge catch configured to hold the ring located closest to the discharge end in a launch position, the discharge catch being movable between a holding position and a release position, and a discharge catch release that is activatable to move the discharge catch to the release position as the drive assembly is activated to rotate the ring.

26. The toy launcher of claim 25, further comprising an advancing catch located at least about a ring width from the discharge catch toward the proximal end of the housing and configured to hold one or more of the rings in the magazine against a force of the spring, the advancing catch being movable between a holding position and a loading position; and an advancing catch release that is activatable to move the advancing catch to a loading position in which a next one of the rings in the magazine assembly is moved to the launch position after a previous one of the rings is launched and the discharge catch has returned to the holding position.

27. The toy launcher of claim 23, wherein the drive assembly includes a slidable handle connected to the housing and configured to be moved linearly to rotate the drive hub.

28. The toy launcher of claim 27, further comprising a gear rack connected to the slidable handle, and a gear train located between the gear rack and the drive hub that is configured to rotate the drive hub as the slidable handle is moved in at least one direction.

29. A toy comprising the toy launcher according to claim 23 and a plurality of the flying rings, each said flying ring having a ring hub with a center opening, an outer ring body, and blades extending from the ring hub to the outer ring body.

30. A toy launcher for flying rings, each ring having a ring hub with a center opening, an outer ring body, and blades extending from the ring hub to the outer ring body, and the toy launcher comprising:

a housing having a proximal end and a discharge end;

a receiving area for a plurality of flying rings that is aligned with a rotation axis of the rings, the receiving area being loadable from a discharge end of the housing;

a ring holder located at a discharge end of the housing and configured to hold one of the rings in a launch position;

a launching mechanism connected to the housing, the launching mechanism comprising:

a drive assembly having a drive hub that is configured to engage the ring hub of the ring held at the discharge end and rotate the ring, and the launching mechanism is adapted to launch the flying rings in a direction of the rotation axis.

31. The toy launcher of claim 30, wherein the launching mechanism further comprises a slidable handle connected to the housing and configured such that movement of the slidable handle from an initial position near the discharge end in a first direction toward the proximal end causes the drive hub to rotate.

32. The toy launcher of claim 31, wherein the launching mechanism further comprises a gear rack connected to the slidable handle, a gear train having at least a first gear that is engageable with the gear rack and a last gear rotationally fixed to the drive hub, wherein movement of the slidable handle from the initial position near the discharge end in the first direction toward the proximal end causes the first gear to rotate and transmit the rotational force via the gear train to the last gear in order to rotate the drive hub connected thereto.

33. A toy launcher for flying rings, each ring having a ring hub with a center opening, an outer ring body, and blades extending from the ring hub to the outer ring body, and the toy launcher comprising:

a housing having a proximal end and a discharge end;

a receiving area for a flying ring;

a launching mechanism connected to the housing, the launching mechanism comprising:

a drive assembly having a drive hub that is configured to engage the ring hub of the ring held at the discharge end and rotate the ring, a release that is activatable as the drive assembly is activated to rotate the ring to allow the ring to be launched, and a discharge catch configured to hold the ring located in the receiving area in a launch position, the discharge catch being movable between a holding position and a release position.

* * * * *